US007655375B2

(12) United States Patent
Yang et al.

(10) Patent No.: US 7,655,375 B2
(45) Date of Patent: Feb. 2, 2010

(54) TONER PARTICLES OF CONTROLLED MORPHOLOGY

(75) Inventors: Xiqiang Yang, Webster, NY (US); Dinesh Tyagi, Fairport, NY (US); Lloyd A. Lobo, Rochester, NY (US); Patrick M. Lambert, Rochester, NY (US); Sandra G. Taft, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 412 days.

(21) Appl. No.: 11/611,226

(22) Filed: Dec. 15, 2006

(65) Prior Publication Data

US 2008/0145780 A1 Jun. 19, 2008

(51) Int. Cl.
*G03G 5/00* (2006.01)

(52) U.S. Cl. ..... 430/137.14; 430/137.1

(58) Field of Classification Search ..... 430/137.14, 430/137.1

See application file for complete search history.

(56) References Cited

U.S. PATENT DOCUMENTS

| | | | | |
|---|---|---|---|---|
| 4,833,060 | A | 5/1989 | Nair et al. | |
| 4,965,131 | A | 10/1990 | Nair et al. | |
| 5,283,151 | A | 2/1994 | Santilli | |
| 6,207,338 | B1 | 3/2001 | Ezenylimba et al. | |
| 6,294,595 | B1 | 9/2001 | Tyagi et al. | |
| 6,380,297 | B1 | 4/2002 | Zion et al. | |
| 6,500,597 | B1 * | 12/2002 | Patel et al. | 430/137.14 |
| 7,041,420 | B2 | 5/2006 | Vandewinckel et al. | |
| 2007/0031748 | A1 | 2/2007 | Kotsugai et al. | |
| 2008/0145779 | A1 | 6/2008 | Yang et al. | |

FOREIGN PATENT DOCUMENTS

| | | |
|---|---|---|
| EP | 1 280 011 | 1/2003 |

* cited by examiner

*Primary Examiner*—Mark A Chapman
(74) *Attorney, Agent, or Firm*—Carl F. Ruoff; Andrew J. Anderson

(57) ABSTRACT

The present invention is a method for the preparation of electrostatographic toner including the following steps. A polymer material is dissolved in an organic solvent to form an organic phase. The organic phase is dispersed in an aqueous phase that includes a particulate stabilizer and a salt including an anion selected from chloride, oxychloride, sulfate, perchlorate, nitrate, dihydrogen phosphate, lactate, trifluoromethylsulfonate, and trifluromethylhydrate and a cation selected from aluminum, iron (III), tin (II) and zirconium (IV), to form a dispersion. The dispersion is homogenized. The organic solvent is evaporated from the dispersion and the resultant product is recovered, washed and dried. In an alternate method the salt is added directly to the dispersion.

20 Claims, No Drawings

TONER PARTICLES OF CONTROLLED MORPHOLOGY

CROSS-REFERENCE TO RELATED APPLICATIONS

This application relates to commonly assigned U.S. Ser. No. 11/611,208 Publication No. 2008/0145779 entitled "TONER PARTICLES OF CONTROLLED MORPHOLOGY" filed simultaneously herewith and hereby incorporated by reference for all that it discloses.

FIELD OF THE INVENTION

This invention relates to a method for the preparation of polymeric powders suitable for use as electrostatographic toner, and more particularly, to a method for the preparation of toner particles of controlled shape in which certain water soluble metal salts are employed for controlling morphology of the toner particles.

BACKGROUND OF THE INVENTION

Electrostatic toner polymer particles can be prepared by a process frequently referred to as "limited coalescence". In this process, polymer particles having a narrow size distribution are obtained by forming a solution of a polymer in a solvent that is immiscible with water, dispersing the solution so formed in an aqueous medium containing a solid colloidal stabilizer and removing the solvent by evaporation. The resultant particles are then isolated, washed and dried.

In the practice of this technique, toner particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by agitation.

Limited coalescence techniques of this type have been described in numerous patents pertaining to the preparation of electrostatic toner particles because such techniques typically result in the formation of toner particles having a substantially uniform size distribution. Representative limited coalescence processes employed in toner preparation are described in U.S. Pat. Nos. 4,833,060 and 4,965,131 to Nair et al.

U.S. Pat. No. 5,283,151 is representative of earlier work in this field and describes the use of carnauba wax to achieve similar toner morphology. The method comprises the steps of dissolving carnauba wax in ethyl acetate heated to a temperature of at least 75° C. and cooling the solution so resulting in the precipitation of the wax in the form of very fine needles a few microns in length; recovering the wax needles and mixing them with a polymer material, a solvent and optionally a pigment and a charge control agent to form an organic phase; dispersing the organic phase in an aqueous phase comprising a particulate stabilizer and homogenizing the mixture; evaporating the solvent and washing and drying the resultant product.

Unfortunately, this technique requires the use of elevated temperature to dissolve the wax in the solvent and cooling the solution to precipitate the wax. The wax does not stay in solution of ethyl acetate at ambient temperature and as a result it is very difficult to scale up using this methodology.

The shapes of the toner particles have a bearing on the electrostatic toner transfer and cleaning properties. Thus, for example, the transfer and cleaning efficiency of toner particles have been found to improve as the sphericity of the particles are reduced. Thus far, workers in the art have long sought to modify the shape of the evaporative limited coalescence type toner particles by means other than the choice of pigment, binder, or charge agent. The shape of the toner particles is modified to enhance the cleaning and transfer properties of the toner.

SUMMARY OF THE INVENTION

The present invention is a method for the preparation of electrostatographic toner including the following steps. A polymer material is dissolved in an organic solvent to form an organic phase. The organic phase is dispersed in an aqueous phase that includes a particulate stabilizer and a salt including an anion selected from chloride, oxychloride, sulfate, perchlorate, nitrate, dihydrogen phosphate, lactate, trifluoromethylsulfonate, and trifluoromethylhydrate and a cation selected from aluminum, iron (III), tin (II) and zirconium (IV), to form a dispersion. The dispersion is homogenized. The organic solvent is evaporated from the dispersion and the resultant product is recovered, washed and dried. In an alternate method the salt is added directly to the dispersion.

DETAILED DESCRIPTION OF THE INVENTION

In accordance with the present invention, a pigment dispersion is prepared by conventional techniques as, for example, by media milling, melt dispersion and the like. The pigment dispersion, polymer material, a solvent, and optionally a charge control agent are combined to form an organic phase in which the pigment concentration ranges from about 4% to 20%, by weight, based upon the total weight of solids. The charge control agent is employed in an amount ranging from 0 to 10 parts per hundred by weight, based on the total weight of solids, with a preferred range from 0.2 to 3.0 parts per hundred. This mixture is permitted to stir overnight and then dispersed in an aqueous phase comprising a particulate stabilizer and optionally a promoter.

The solvents chosen for use in the organic phase steps may be selected from among any of the well-known solvents capable of dissolving polymers. Typical of the solvents chosen for this purpose are chloroform, dichloromethane, ethyl acetate, vinyl chloride, methyl ethyl ketone, and the like.

The particulate stabilizer selected for use herein may be selected from among highly cross-linked polymeric latex materials of the type described in U.S. Pat. No. 4,965,131 to Nair et al., or silicon dioxide. Silicon dioxide is preferred. It is generally used in an amount ranging from 1 to 15 parts by weight based on 100 parts by weight of the total solids of the toner employed. When silicon dioxide is used, it may be optionally removed from the final toner by treatment with a strong base. The size and concentration of these stabilizers control and predetermine the size of the final toner particles. In other words, the smaller the size and/or the higher the concentration of such particles, the smaller the size of the final toner particles.

Any suitable promoter that is water soluble and affects the hydrophilic/hydrophobic balance of the solid dispersing agent in the aqueous solution may be employed in order to drive the solid dispersing agent, that is, the particulate stabilizer, to the polymer/solvent droplet-water interface. Typical of such promoters are sulfonated polystyrenes, alginates, carboxymethylcellulose, tetramethyl ammonium hydroxide or chloride, diethylaminoethyl methacrylate, water soluble complex resinous amine condensation products of ethylene oxide, urea and formaldehyde and polyethyleneimine. Also, effective for this purpose are gelatin, casein, albumin, gluten and the like or non-ionic materials such as methoxycellulose. The promoter is generally used in an amount from about 0.2 to about 0.6 parts per 100 parts, by weight, of aqueous solution.

In one mode of the present invention, suitable metal salts are incorporated in the aqueous phase when toner particles of non-spherical shape are desired. The salts are generally water-soluble ionic compounds of aluminum, iron (III), tin (II), and zirconium (IV), and the anions are chlorides, perchlorates, sulfates, nitrates, and their hydrates, and selected organic salts such as lactates and sulfonates, for example, trifluoromethylsulfonate. The salt can be directly used to prepare the aqueous phase, or a more concentrated solution of the salt can first be prepared, and a small volume of the concentrated solution is added to a certain volume of the original aqueous phase, such that the composition and property of the aqueous phase is not substantially changed.

Because of the different molecular weights of different salts, the amount of salt in the aqueous phase is more conveniently measured in units of moles metal relative to the weight of silica used in the aqueous phase provided that colloidal silica of the same particle size is used. Since the toner particle size is inversely proportional to the silica particle size when a constant weight of silica is used, this translates to moles of metal normalized according to the equivalent circular diameter of the resulting particle, which is represented by the volume median weight of silica in the aqueous phase. When silica of various particle size is used as the particulate stabilizer, the amount of metal salt, expressed as millimoles of metal multiplied by the diameter of the toner particles (in microns), is generally above about 1.0 [mmole-micron] per one hundred grams of toner in order to obtain irregular-shaped toners. Preferably it is used in the range of 2.0 to 100 [mmole-microns] per one hundred grams of toner. More preferably it is used in the range of 2.0 to 50 [mmole-microns] per one hundred grams of toner.

Various additives generally present in electrostatographic toner may be added to the polymer prior to dissolution in the solvent or in the dissolution step itself, such as charge control agents, waxes and lubricants. Suitable charge control agents are disclosed, for example, in U.S. Pat. Nos. 3,893,935 and 4,323,634 to Jadwin et al. and U.S. Pat. No. 4,079,014 to Burness et al., and British Patent No. 1,420,839 to Eastman Kodak. Charge control agents are generally employed in small quantities such as from about 0.01 to 10 parts per hundred by weight based upon the weight of the total solids content (weight of the toner) and preferably from about 0.2 to about 3.0 parts per hundred.

The resultant mixture is then subjected to mixing and homogenization. In this process, the particulate stabilizer forms an interface between the organic globules in the organic phase. Due to the high surface area associated with small particles, the coverage by the particulate stabilizer is not complete. Coalescence continues until the surface is completely covered by particulate stabilizer. Thereafter, no further growth of the particles occurs. Accordingly, the amount of the particulate stabilizer is inversely proportional to the size of the toner obtained. The relationship between the aqueous phase and the organic phase, by volume may range from 1:1 to approximately 9:1. This indicates that the organic phase is typically present in an amount from about 10% to 50% of the total homogenized volume.

In another mode of the invention, the metallic salt is introduced to the emulsion after it has been homogenized and the limited coalescence has taken place. The salt is thus added as a solution, preferably essentially aqueous, which optionally can contain an organic or inorganic buffer salt. The amount of salt used in this way can be varied in order to produce shapes of different degrees for the resulting toner. In general, the range of salt use is similar to that described for the first mode of the invention.

Following the homogenization treatment and optionally the introduction of the shape control agent, the solvent present is evaporated and the resultant product washed and dried.

As indicated, the present invention is applicable to the preparation of polymeric toner particles from any type of polymer that is capable of being dissolved in a solvent that is immiscible with water and includes compositions such as, for example, olefin homopolymers and copolymers, such as, polyethylene, polypropylene, polyisobutylene and polyisopentylene; polytrifluoroolefins; polytetrafluoroethylene and polytrifluorochloroethylene; polyamides, such as poly(hexamethylene adipamide), poly(hexamethylene sebacamide), and polycaprolactam; acrylic resins, such as poly(methyl methacrylate), poly(methyl acrylate), poly(ethyl methacrylate) and poly(styrene-methyl methacrylate); ethylene-methyl acrylate copolymers, ethylene-ethyl acrylate copolymers, ethylene-ethyl methacrylate copolymers, polystyrene and copolymers of styrene with unsaturated monomers, cellulose derivatives, polyesters, polyvinyl resins and ethylene-allyl alcohol copolymers and the like.

Pigments suitable for use in the practice of the present invention should be capable of being dispersed in the polymer, insoluble in water and yield strong permanent color. Typical of such pigments are the organic pigments such as phthalocyanines, lithols and the like and inorganic pigments such as $TiO_2$, carbon black and the like. Typical of the phthalocyanine pigments are copper phthalocyanine, a mono-chlor copper phthalocyanine, and hexadecachlor copper phthalocyanine. Other organic pigments suitable for use herein include anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthramide brown CL1151, dibenzanthrone green CL1101, flavanthrone yellow CL1118, azo pigments such as toluidine red C169 and hansa yellow; and metallized pigments such as azo yellow and permanent red. The carbon black may be any of the known types such as channel black, furnace black, acetylene black, thermal black, lamp black and aniline black. The pigments are employed in an amount sufficient to give a content thereof in the toner from about 1% to 40%, by weight, based upon the weight of the toner, and preferably within the range of 4% to 20%, by weight.

The pH value of the aqueous phase is important for metal ions such as aluminum to function as shape control agents. Preferred pH range is 3.5 to 6.0. The more preferred range is 4.0 to 5.5. Changes in aqueous phase pH also impact the resulting toner particle size when aluminum ion is included in the aqueous phase. Preferred mode of use for aluminum salt is therefore after homogenization but before removal of the organic solvent.

When typical aluminum salt is dissolved in water, the resulting aqueous solution can be acidic. In order not to significantly change the pH values of the homogenized dispersion, it may be desirable to increase the pH of the aluminum salt solution to above 4.0 with the addition of a basic organic buffer salt such as potassium hydrogen phthalate, potassium acetate, potassium lactate or the like. Alternatively, the buffer concentration of the aqueous phase may be increased to resist and diminish the effect on mixture pH by the acidic salt solution. An additional method is to increase aqueous phase pH so that the mixture after salt addition is still maintained in the acceptable pH range.

Example 1

Preparation of Wax Dispersion

To a glass jar containing a mixture of wax and dispersant in ethyl acetate were added zirconia beads (diameter 1.2 mm). The container was then placed on a Sweco powder grinder and the wax milled for about one to three days. Afterwards, the beads were removed by filtration through a screen and the resulting solid particle dispersion was used for toner preparation as follows.

| | |
|---|---|
| Disp A. | Polywax 500 (Baker Petrolite, T-60 grade), 20.0 g<br>Tuftec ™ P2000 (AK Elastomer), 3.0 g<br>Ethyl Acetate, 77.0 g<br>Zirconia Beads, 1.2 mm, 100 mL<br>Determined solid content of recovered dispersion: 17.4% |

Example 2

An organic phase dispersion was prepared using 89.08 g of ethyl acetate. 19.78 g of Kao Binder E, 2.919 g of BASF Lupreton Blue SE 1163, and 13.22 g of the above wax dispersion A. The mixture was stirred overnight with a magnetic stirrer. This organic phase is mixed with an aqueous mixture prepared with 172.93 g of water, 1.1475 g of potassium hydrogen phthalate (KHP), 11.00 g of Nalco™ 1060 and 2.42 g of 10% promoter (poly(adipic acid-comethylaminoethanol)). This mixture was then subjected to very high shear using a Silverson L4R Mixer (sold by Silverson Machines, Inc.) followed by a Microfluidizer.

a) Example 2a. To 90.0 g of the homogenized mixture were added 0.48 ml of a 10% solution of $Al(NO_3)_3.9H_2O$ in water. The solvent in the mixture was then removed on a rotary evaporator under reduced pressure. The solid toner particles were recovered, washed and dried. After further drying in a vacuum oven, the toner particles had a volume median diameter of 6.53 μm.

b) Example 2b. To another 90.0 g of the homogenized mixture were added 0.12 mL of a 10% solution of $Al(NO_3)_3.9H_2O$ in water and after the same treatment as in a), the final particles had a volume median diameter of 5.75 μm.

c) Example 2c (Comparative). The remaining homogenized mixture was processed without the use of any solution of $Al(NO_3)_3.9H_2O$. The resulting particles had a volume median diameter of 5.75 μm as measured on a Coulter multisizer.

The particles obtained above were analyzed in terms of shape analysis using a Sysmex FPIA-3000 instrument (Sysmex Corporation). The shape of a particle is quantified by the mean circularity and mean aspect ratio as calculated by the Sysmex software. Value of unity indicates perfect sphere, while numbers smaller than one describe irregular shaped particles. Results are given below and the trend of more irregular shape with the use of more aluminum nitrate salt solution can be seen from the data in Table 1.

TABLE 1

| | | Circularity | | Aspect Ratio (W/L) | |
|---|---|---|---|---|---|
| Example | | Mean | SD | Mean | SD |
| 2a | Inventive | 0.968 | 0.027 | 0.872 | 0.077 |
| 2b | Inventive | 0.986 | 0.029 | 0.927 | 0.065 |
| 2c | Comparative | 0.988 | 0.023 | 0.927 | 0.059 |

Table 1 shows also that at the lower level of aluminum ion in the aqueous phase led to only slightly shaped toner particles. This slight exhibition of particle shape is evident from the somewhat larger standard deviation (SD) in circularity, and also that in aspect ratio, for Example 2b when compared with Example 2c.

Example 3

Three organic phases were prepared, each with 53.45 g of ethyl acetate 11.87 g of Kao Binder E, 1.75 g of BASF Lupreton Blue SE 1163, and 7.93 g of the above wax dispersion A. The mixtures were stirred overnight with a magnetic stirrer.

Aqueous mixtures were prepared with various amounts of aluminum nitrate as follows.

| Aqueous phase | 3a | 3b | 3c |
|---|---|---|---|
| Water, g | 104.04 | 103.59 | 103.14 |
| Nalco ™ 1060, g | 6.00 | 6.00 | 6.00 |
| 10% Promoter, g | 1.320 | 1.320 | 1.320 |
| KHP, g | 0.689 | 0.689 | 0.689 |
| 10% $Al(NO_3)_3 \cdot 9H_2O$, g | 0.450 | 0.900 | 1.350 |
| Total, g | 112.50 | 112.50 | 112.50 |

Each organic phase was mixed in with the appropriate aqueous phase using a Silverson L4R Mixer at high shear rate and further homogenized with a microfluidizer. Upon exiting the microfluidizer the organic solvent was removed under reduced pressure with a rotary evaporator. The toner particles were collected and washed. After drying in air and in vacuum oven, the toner particles were measured with a Coulter multisizer, and the shape with a Sysmex FPIA-3000 Image Analyzer. The results in Table 2 indicate that the aluminum nitrate solution in the aqueous phase affords irregular shaped toner particles.

TABLE 2

| | Al | Vol Median Diameter | Circularity | | Aspect Ratio (W/L) | |
|---|---|---|---|---|---|---|
| Example | level* | (μ) | Mean | SD | Mean | SD |
| 3a | 5.7 | 6.93 | 0.985 | 0.010 | 0.913 | 0.084 |
| 3b | 11.4 | 7.63 | 0.971 | 0.014 | 0.858 | 0.109 |
| 3c | 17.1 | 6.09 | 0.969 | 0.015 | 0.850 | 0.094 |

*In units of mmoles · diameter per hundred gram of toner with diameter set at 6.0 microns.

Example 4

Clear Toner Particles

In this example, the metal ion salts, zirconium (IV) chloride, tin (IV) chloride, and zirconium (IV) sulfate were used in the preparation of clear toners, i.e., toner particles that do not contains colorants. These salts were added as 10% aqueous solution into the aqueous phase in the evaporative limited coalescence process. Each organic phase was comprised of 20.0 g of Kao Binder E and 80.0 g of ethyl acetate. The aqueous phases each contained 0.918 g of potassium hydrogen phthalate, 8.80 g of Nalco™ 1060, and 1.936 g of 10% promoter solution, and the respective salt solution, and weighed 150.0 g total. The preparation process was the same as in Example 3, and the resulting toners were analyzed as above to give results as shown in Table 3. The salts of aluminum and zirconium gave totally irregular toner particles as indicated by the circularity and aspect ratio data.

TABLE 3

| Example | Salt in Aq. Phase | SCA level* | Vol Median Diameter (μ) | Circularity Mean | Circularity SD | Aspect Ratio (W/L) Mean | Aspect Ratio (W/L) SD |
|---|---|---|---|---|---|---|---|
| 4a | $ZrCl_4$ | 10.3 | 5.02 | 0.964 | 0.024 | 0.840 | 0.098 |
| 4b | $SnCl_4$ | 9.2 | 6.18 | 0.986 | 0.011 | 0.911 | 0.087 |
| 4c | $Zr(SO_4)_2$ | 8.5 | 5.39 | 0.944 | 0.032 | 0.789 | 0.102 |

*In units of mmoles · diameter per hundred gram of toner with diameter set at 6.0 microns.

It can be seen from the aspect ratio results that zirconium salt solutions cause the toner particles to have very irregular shape and they are powerful shape control agents regardless of the counterions (chloride or sulfate). On the other hand $SnCl_4$ is not very effective at causing shape in the resulting toner particles.

Example 5

Clear Toner Particles

In this example, the metal ion salts ferric (III) nitrate nonahydrate, and zirconium (IV) oxychloride were used in the preparation of clear toners. These salts were added again into the aqueous phase in the evaporative limited coalescence process. The toner preparation process was the same as in example 4, and the resulting toners were analyzed as above to give results as shown in Table 4. Both salts gave irregular toner particles.

TABLE 4

| Example | Salt in Aq. Phase | SCA Level | Vol Median Diameter (μ) | Circularity Mean | Circularity SD | Aspect Ratio Mean | Aspect Ratio SD |
|---|---|---|---|---|---|---|---|
| 5a | $ZrOCl_2$ | 10.1 | 5.25 | 0.952 | 0.022 | 0.792 | 0.107 |
| 5b | $Fe(NO_3)_3 \cdot 9H_2O$ | 8.91 | 6.05 | 0.987 | 0.011 | 0.927 | 0.052 |

*In units of mmoles · diameter per hundred gram of toner with diameter set at 6.0 microns.

It can be seen that zirconium oxychloride behaves very much like the zirconium chloride (and sulfate) and is a strong shape control agent. Ferric nitrate is relatively weak in this way of application, i.e., when used directly in the aqueous phase of the toner preparation process.

Example 6

Clear Toner Particles

In this example, relatively large quantities of zirconium (IV) chloride and ferric (III) nitrate nonahydrate were used in the preparation of clear toners. These salts were added as 3.0% aqueous solution into the homogenized emulsion mixture as it exited the microfluidizer, for a total weight 0.30 g for each salt. Each organic phase was comprised of 20.0 g of Kao Binder E and 80.0 g of ethyl acetate. The aqueous phases each contained 0.918 g of potassium hydrogen phthalate, 8.80 g of Nalco™ 1060, and 1.936 g of 10% promoter solution, and weighed 150.0 g total. The organic phase wax mixed with the aqueous phase and the mixture was subject to very high shear with a Silverson Lab mixer followed by a microfluidizer. Upon exiting, as stated above, the mixture was treated with 10.0 g of the 3.0% salt solution, and the solvent removed under reduced pressure on a rotary evaporator. The resulting toners were collected and washed. After drying, the particles were analyzed as above to give results as shown in Table 5. The salts of zirconium (IV) and iron (III) gave totally irregular toner particles as indicated by the circularity and aspect ratio data. At the high levels, the particles obtained were of low aspect ratios.

TABLE 5

| Example | Salt After Homogenization | SCA level* | Vol Median Diameter (μ) | Circularity Mean | Circularity SD | Aspect Ratio Mean | Aspect Ratio SD |
|---|---|---|---|---|---|---|---|
| 6a | $ZrCl_4$ | 38.6 | 7.8 | 0.836 | 0.054 | 0.488 | 0.091 |
| 6b | $Fe(NO_3)_3 \cdot 9H_2O$ | 22.3 | 7.5 | 0.861 | 0.046 | 0.503 | 0.103 |

*In units of mmoles · diameter per hundred gram of toner.

Example 7

Clear Toner Particles

In this example, tin (II) chloride was used in the preparation of clear toners. These salts were added as 1.5% aqueous solution into the homogenized emulsion mixture as it exited the microfluidizer. Each organic phase was comprised of 15.0 g of Kao Binder E and 60.0 g of ethyl acetate. The aqueous phases each contained 0.689 g of potassium hydrogen phthalate, 6.60 g of Nalco™ 1060, and 1.452 g of 10% promoter solution, and weighed 112.50 g total. The organic phase wax mixed with the aqueous phase and the mixture was subject to very high shear with a Silverson Lab mixer followed by a microfluidizer. Upon exiting, as stated above, the mixture was treated with 5.95 g of the 1.50% salt solution, and the solvent removed under reduced pressure on a rotary evaporator. The resulting toners were collected and washed. After drying, the particles were analyzed as above to give results as shown in Table 6. The resulting toner particles are of irregular shape as indicated by the aspect ratio data.

TABLE 6

| Example | Salt After Homogenization | SCA level* | Vol Median Diameter (μ) | Circularity Mean | Circularity SD | Aspect Ratio Mean | Aspect Ratio SD |
|---|---|---|---|---|---|---|---|
| 7a | $SnCl_2$ | 5.7 | 7.1 | 0.923 | 0.049 | 0.720 | 0.108 |
| 7b | $SnCl_2$ | 4.5 | 6.2 | 0.932 | 0.046 | 0.741 | 0.112 |

*In units of mmoles · diameter per hundred gram of toner.

Example 8

A continuous evaporator was used to remove the solvent instead of a rotary evaporator. The evaporator was heated with 63° C. water and kept under a vacuum of 120 mmHg.

The product dispersion is mixed with the metallic salt solution of the instant invention, and pumped through the heat exchanger. Water heated to 63° C. is pumped through the heat exchanger and the vacuum was set at 120 mm of Hg. The flow rate of the dispersion was 3.6 Kg/min. A sample of the product is collected after 7 minutes of running, which is when steady state is achieved. The organic phase was made of 2 Kg of BASF Lupreton Blue SE 1163, 12.9 Kg of Kao Binder F and 60 Kg of ethyl acetate. The aqueous phase was made up of 10.62 Kg water with either 30 or 100 mM of potassium hydrogen phthalate, 7.6 Kg of Nalcoag 1060 (colloidal silica), and 1.68 g of a 10% promoter solution. The pH of the aqueous phase is adjusted to pH of 4 or 5 using either a 30 mM or 100 mM of KOH solution.

The aluminum nitrate nonahydrate concentration in the salt solution was maintained at 1.4%. The native pH of this solution is between 2.8 and 3.0. In some instances the pH value of this solution was adjusted by including 120 mM of potassium hydrogen phthalate and addition of a 2.75% KOH solution. The final concentration of aluminum nitrate nonahydrate was 1.4%. The aluminum nitrate solution was added to the homogenized dispersion and pumped through the evaporator at 3.4 Kg/min. The product was sampled after a steady state operation was achieved through the continuous evaporator, which was between 5 and 10 min. The particle size was measured by a Coulter counter and the shape was measured by Sysmex analysis. The volume median diameter was used as the measure of size and the Width/length aspect ratio was used as a measure of shape. The mean of this aspect ratio is reported in the table below:

As shown above the desired shape can be obtained by different methods. Since the final pH of the dispersion attenuates the amount of shape, it is possible to adjust the pH of the aluminum nitrate solution, or the pH of the aqueous phase of the dispersion or both. The amount of buffering capability is another adjustable parameter. The aluminum nitrate solution in water has a native pH of 3 whereas the pH 4 solutions in the above table were adjusted with potassium hydrogen phthalate and KOH solution. At the higher pH the aluminum nitrate solutions are unstable. Based on the above table it is seen that it is preferable to adjust the pH of the aqueous phase of the dispersion to 5.0 (which doesn't change the characteristics of the particle size distribution substantially) and not adjust the pH of the aluminum nitrate solution.

The invention has been described in detail with particular reference to certain preferred embodiments thereof, but it will be understood that variations and modifications can be effected within the spirit and scope of the invention.

The invention claimed is:

1. A method for the preparation of electrostatographic toner comprising the steps of:

a) dissolving a polymer material in an organic solvent to form an organic phase;

b) dispersing the organic phase in an aqueous phase comprising a particulate stabilizer and a shape control agent salt comprising an anion selected from the group consisting of chloride, oxychloride, sulfate, perchlorate, nitrate, dihydrogen phosphate, lactate, trifluoromethylsulfonate, and trifluoromethylhydrate and a cation selected from the group consisting of aluminum, iron (III), tin (II) and zirconium (IV), to form a dispersion and homogenizing the resultant dispersion;

c) evaporating the organic solvent and recovering a resultant product having a shape modified by the shape control agent; and d) washing and drying the resultant product.

2. The method of claim 1 wherein a charge control agent or pigment is added in step a).

3. The method of claim 1 wherein a promoter is added in the dispersing step in b).

TABLE 7

| Example | SCA level | pH of aluminum nitrate solution | Stability of Al nitrate solution | aq. pH | buffer strength mM | Final pH | aspect ratio mean | asp. Ratio SD | diameter um |
|---|---|---|---|---|---|---|---|---|---|
| 7a | 12.6 | 4.0 | unstable | 4.0 | 30 | 4.1 | 0.86 | 0.076 | 5.8 |
| 7b | 16.8 | 4.0 | unstable | 4.0 | 30 | 4.1 | 0.795 | 0.107 | 5.9 |
| 7c | 21.0 | 4.0 | unstable | 4.0 | 30 | 4.1 | 0.762 | 0.112 | 6.0 |
| 7d | 12.6 | 4.0 | unstable | 5.0 | 30 | | 0.79 | 0.101 | 6.6 |
| 7e | 16.8 | 4.0 | unstable | 5.0 | 30 | | 0.779 | 0.109 | 6.6 |
| 7f | 8.40 | 4.0 | unstable | 5.0 | 30 | | 0.774 | 0.105 | 6.5 |
| 7g | 4.20 | 4.0 | unstable | 5.0 | 30 | | 0.923 | 0.033 | 5.9 |
| 7h | 4.20 | 3.0 | stable | 5.0 | 30 | 4.9 | 0.91 | 0.048 | 6.0 |
| 7i | 8.40 | 3.0 | stable | 5.0 | 30 | 4.66 | 0.786 | 0.1 | 6.2 |
| 7j | 12.6 | 3.0 | stable | 5.0 | 30 | 4.55 | 0.826 | 0.089 | 6.2 |
| 7k | 4.20 | 3.0 | stable | 5.0 | 100 | 5.00 | 0.929 | 0.026 | 6.2 |
| 7l | 8.40 | 3.0 | stable | 5.0 | 100 | 4.96 | 0.865 | 0.077 | 6.6 |
| 7m | 12.6 | 3.0 | stable | 5.0 | 100 | 4.98 | 0.835 | 0.088 | 7.4 |
| 7n | 5.25 | 3.0 | stable | 5.0 | 30 | | 0.875 | 0.071 | 6.0 |
| 7o | 6.30 | 3.0 | stable | 5.0 | 30 | | 0.837 | 0.09 | 6.5 |
| 7p | 7.35 | 3.0 | stable | 5.0 | 30 | | 0.809 | 0.097 | 6.1 |

*In units of mmoles · diameter per hundred gram of toner.

4. The method of claim 1 wherein the solvent is selected from the group consisting of chloroform, dichloromethane, ethyl acetate, vinyl chloride, and methyl ethyl ketone.

5. The method of claim 1 wherein the amount of particulate stabilizer is between 1 to 15 pails, by weight, based on 100 parts of total solids in the toner.

6. The method of claim 1 wherein the ratio of the aqueous phase to the organic phase, by volume, ranges from 1:1 to 9:1.

7. The method of claim 1 wherein the organic phase contains lubricants or waxes.

8. The method of claim 1 where a pH value of the aqueous phase is between 3.5 and 6.0.

9. The method of claim 1 wherein the polymer material comprises a homopolymer or copolymer selected from the group consisting of polyethylene, polypropylene, polyisobutylene, polyisopentylene, polytrifluoroolefins, polyamides, acrylic resins, ethylene-methyl acrylate copolymers, ethylene-ethyl acrylate copolymers, ethylene-ethyl methacrylate copolymers, polystyrene and copolymers of styrene with unsaturated monomers, polyesters, polyvinyl resins, ethylene-allyl alcohol copolymers, polytetrafluoroethylene, polytrifluorochloroethylene, poly(hexamethylene adipamide), poly(hexamethylene sebacamide), polycaprolactam, poly(methyl methacrylate), poly(methyl acrylate), poly(ethyl methacrylate) and poly(styrene-methyl methacrylate).

10. The method of claim 1 wherein the salt comprises aluminum nitrate, aluminum sulfate, aluminum perchlorate, aluminum lactate, aluminum dihydrogen phosphate, or aluminum trifluoromethylsulfonate.

11. A method for the preparation of electrostatographic toner comprising the steps of:

a) dissolving a polymer material in an organic solvent to form an organic phase;

b) dispersing the organic phase in an aqueous phase comprising a particulate stabilizer to form a dispersion and homogenizing the resultant dispersion;

c) adding a shape control agent salt comprising an anion selected from the group consisting of chloride, oxychloride, sulfate, perchlorate, nitrate, dihydrogen phosphate, lactate, trifluoromethylsulfonate, and trifluoromethylhydrate and a cation selected from the group consisting of aluminum, iron (III), tin (II) and zirconium (IV), to the resultant dispersion;

d) evaporating the organic solvent and recovering a resultant product having a shape modified by the shape control agent; and e) washing and drying the resultant product.

12. The method of claim 11 wherein a charge control agent or pigment is added in step a).

13. The method of claim 11 wherein a promoter is added in the dispersing step in b).

14. The method of claim 11 wherein the solvent is selected from the group consisting of chloroform, dichloromethane, ethyl acetate, vinyl chloride, and methyl ethyl ketone.

15. The method of claim 11 wherein the amount of particulate stabilizer is between 1 to 15 pads, by weight, based on 100 parts of total solids in the toner.

16. The method of claim 11 wherein the ratio of the aqueous phase to the organic phase, by volume, ranges from 1:1 to 9:1.

17. The method of claim 11 wherein the organic phase contains lubricants, pigments or waxes.

18. The method of claim 11 wherein the polymer material comprises a homopolymer or copolymer selected from the group consisting of polyethylene, polypropylene, polyisobutylene, polyisopentylene, polytrifluoroolefins, polyamides, acrylic resins, ethylene-methyl acrylate copolymers, ethylene-ethyl acrylate copolymers, ethylene-ethyl methacrylate copolymers, polystyrene and copolymers of styrene with unsaturated monomers, polyesters, polyvinyl resins, ethylene-allyl alcohol copolymers, polytetrafluoroethylene, polytrifluorochloroethylene, poly(hexamethylene adipamide), poly(hexamethylene sebacamide), polycaprolactam, poly(methyl methacrylate), poly(methyl acrylate), poly(ethyl methacrylate) and poly(styrene-methyl methacrylate).

19. The method of claim 11 where a pH value of the aqueous phase is between 3.5 and 6.0.

20. The method of claim 11 wherein the salt comprises aluminum nitrate, aluminum sulfate, aluminum perchlorate, aluminum lactate, aluminum dihydrogen phosphate, or aluminum trifluoromethylsulfonate.

* * * * *

UNITED STATES PATENT AND TRADEMARK OFFICE

CERTIFICATE OF CORRECTION

PATENT NO. : 7,655,375 B2
APPLICATION NO. : 11/611226
DATED : February 2, 2010
INVENTOR(S) : Yang et al.

It is certified that error appears in the above-identified patent and that said Letters Patent is hereby corrected as shown below:

First Page, Col. 2, in the Abstract delete "trifluromethylhydrate" and insert -- trifluoromethylhydrate --.

In Column 11, Claim 5, line 5, delete "pails," and insert -- parts, --.

In Column 12, Claim 15, line 16, delete "pads," and insert -- parts, --.

Signed and Sealed this

Twentieth Day of April, 2010

David J. Kappos

David J. Kappos
*Director of the United States Patent and Trademark Office*